US012280924B2

(12) United States Patent
Hayashi

(10) Patent No.: US 12,280,924 B2
(45) Date of Patent: Apr. 22, 2025

(54) PLUG BODY AND BEVERAGE CONTAINER

(71) Applicant: TIGER CORPORATION, Osaka (JP)

(72) Inventor: Shinji Hayashi, Osaka (JP)

(73) Assignee: TIGER CORPORATION, Osaka (JP)

( * ) Notice: Subject to any disclaimer, the term of this patent is extended or adjusted under 35 U.S.C. 154(b) by 67 days.

(21) Appl. No.: 17/569,429

(22) Filed: Jan. 5, 2022

(65) Prior Publication Data

US 2022/0306354 A1 Sep. 29, 2022

(30) Foreign Application Priority Data

Mar. 29, 2021 (JP) ..... 2021-055742

(51) Int. Cl.
*B65D 47/14* (2006.01)
*A45F 3/16* (2006.01)
*B65D 55/16* (2006.01)

(52) U.S. Cl.
CPC ..... *B65D 47/142* (2013.01); *A45F 3/16* (2013.01); *B65D 55/16* (2013.01)

(58) Field of Classification Search
CPC .. B65D 47/142; B65D 55/16; B65D 51/1644; B65D 81/3841; A45F 3/16
USPC ..... 220/44
See application file for complete search history.

(56) References Cited

U.S. PATENT DOCUMENTS 5,079,013 A * 1/1992 Belanger ..... A61J 9/04 215/11.4
5,542,670 A * 8/1996 Morano ..... A47G 19/2272 220/717
5,655,686 A * 8/1997 Jermyn ..... B05B 11/047 222/481.5
5,873,478 A * 2/1999 Sullivan ..... A47G 19/2266 222/534
6,786,352 B2 * 9/2004 Belcastro ..... A47G 19/2272 220/717
9,222,450 B2 * 12/2015 Whelan ..... B60K 15/03519
10,683,155 B2 * 6/2020 Ho ..... B65D 79/0087
2012/0080429 A1 * 4/2012 Steininger ..... B65D 47/286 220/200
2014/0001212 A1 * 1/2014 Steininger ..... B65D 47/2043 222/209
2016/0167863 A1 * 6/2016 Han ..... B65D 51/1644 220/256.1
2016/0194118 A1 * 7/2016 Huber ..... B65D 47/14 220/254.2
2019/0135517 A1 * 5/2019 Wu ..... A47G 19/2205
2020/0180854 A1 * 6/2020 Christiansen ..... B67D 1/125

FOREIGN PATENT DOCUMENTS

AU 2014202815 A1 * 2/2015 ..... B60K 15/0406
JP H0647160 6/1994
JP 2003155050 A * 5/2003
JP 2007112481 A * 5/2007
WO WO-2009151188 A1 * 12/2009 ..... A45D 34/00

* cited by examiner

*Primary Examiner* — Don M Anderson
*Assistant Examiner* — Eric C Baldrighi
(74) *Attorney, Agent, or Firm* — JCIPRNET

(57) ABSTRACT

A plug body includes a spout part and a pressure release valve arranged at a position different from an arrangement position of the spout part. A mass on a spout part side is larger than a mass on a pressure release valve side.

9 Claims, 7 Drawing Sheets

PLUG BODY AND BEVERAGE CONTAINER

CROSS-REFERENCE TO RELATED APPLICATION

This application claims the priority benefit of Japan application serial no. 2021-055742, filed on Mar. 29, 2021. The entirety of the above-mentioned patent application is hereby incorporated by reference herein and made a part of this specification.

BACKGROUND

Technical Field

The disclosure relates to a plug body. Further, the disclosure relates to a beverage container attached with the plug body.

Related Art

In the past, a gas exhaust plug body configured in the following manner has been proposed (see, for example, Japanese Utility Model Application Publication No. H6-47160). In a plug body composed of an inner plug that has an opening part fitted into a container mouth and an overcap that seals the container mouth, a plurality of exhaust holes are provided on an upper side surface of the overcap, a spring member and a movable valve having an insertion hole are provided at an inner center, and a shaft plug provided with a ventilation groove is inserted into the insertion hole at the center of the movable valve.

When the conventional plug body as described above, attached to a container, has been tilted by a certain amount or more or completely rolled over, since the pressure release valve is immersed in the content of the container, there is a high possibility that the content of the container will leak out upon gas release (pressure release), or there is a high possibility that the movable valve (pressure release valve) will not operate as specified.

SUMMARY

A plug body according to an embodiment of the disclosure includes a spout part and a pressure release valve arranged at a position different from an arrangement position of the spout part. A mass on a spout part side is larger than a mass on a pressure release valve side.

According to the above configuration, when attached to the container and having been tilted by a certain amount or more or completely rolled over, the pressure release valve is located above the spout part, and it is possible to reduce possibility that the pressure release valve is immersed in the content of the container. Therefore, when the plug body, attached to the container, has been tilted by a certain amount or more or completely rolled over, it is possible to reduce the possibility that the content of the container leaks out upon pressure release, and it is also possible to reduce the possibility that the pressure release valve does not operate as specified.

The plug body according to an embodiment of the disclosure may further include a space forming part which forms a space on a lower side of the spout part. An inlet of the pressure release valve may be formed at the space forming part.

According to the above configuration, when the plug body, attached to the container, has been tilted by a certain amount or more or completely roller over, the content of the container flows into the space, and the air moves to the pressure release valve side. Therefore, when the plug body, attached to the container, has been tilted by a certain amount or more or completely rolled over, it is possible to further reduce the possibility that the content of the container leaks out upon pressure release, and it is also possible to further reduce the possibility that the pressure release valve does not operate as specified.

The plug body according to an embodiment of the disclosure may further include a plug detachably provided at the spout part. The plug may be attached to a portion of the pressure release valve on an opposite side of the spout part side via a strap.

According to the above configuration, when the plug body, attached to the container, has been tilted by a certain amount or more or completely rolled over, the strap can reduce the possibility that the pressure release valve comes completely to the lower side. Therefore, it is possible to reduce the possibility that the pressure release valve is immersed in the content of the container.

In the plug body according to an embodiment of the disclosure, a passage extending in a direction having a vertical direction component may be formed between an inlet and an outlet of the pressure release valve.

According to the above configuration, when not only gas but also bubbles or the like enter from the inlet of the pressure release valve, part or all of the bubbles can be trapped by the passage, and it is possible to reduce the amount of bubbles leaking out of the plug body or prevent the bubbles from leaking out of the plug body.

The plug body according to an embodiment of the disclosure may further include a shoulder member and a first sealing member. The shoulder member may have an opening projecting the spout part upward and may be covered on the pressure release valve. The first sealing member may separate an outlet of the pressure release valve and the opening.

According to the above configuration, when not only gas but also bubbles or the like enter from the inlet of the pressure release valve, the first sealing member can reduce the possibility that the bubbles leak out from the opening of the shoulder member. Further, in the plug body, the pressure release valve is covered with the shoulder member. Therefore, the design property of the plug body can be improved.

In the plug body according to an embodiment of the disclosure, the pressure release valve may include a valve body and an urging member which urges the valve body toward an inlet side.

According to the above configuration, the acting force of the urging member can be controlled by simply changing the urging load of the urging member according to the relationship "pressure=force/area".

A beverage container according to an embodiment of the disclosure includes the plug body described above and a container in a bottomed cylindrical shape to which the plug body is attached.

According to the above configuration, when the beverage container has been tilted by a certain amount or more or completely rolled over, the pressure release valve is located above the spout part, and it is possible to reduce the possibility that the pressure release valve is immersed in the content of the container. Therefore, when the beverage container has been tilted by a certain amount or more or completely rolled over, it is possible to reduce the possibility that the content of the container leaks out upon pressure release, and it is also possible to reduce the possibility that the pressure release valve does not operate as specified.

In the beverage container according to an embodiment of the disclosure, the pressure release valve may be opposed to the spout part across an extending line of a cylinder axis of the container in a plan view.

According to the above configuration, the action effect described above can be maximized.

In the beverage container according to an embodiment of the disclosure, the plug body may be a plug body including a shoulder member and a first sealing member. The shoulder member has an opening projecting the spout part upward and is covered on the pressure release valve. The first sealing member separates an outlet of the pressure release valve and the opening. The beverage container may further include a second sealing member which seals between a plug body attachment portion of the container and the shoulder member.

According to the above configuration, when not only gas but also bubbles or the like enter from the inlet of the pressure release valve, not only can the first sealing member reduce the possibility that the bubbles leak out from the opening of the shoulder member, but the second sealing member can also reduce the possibility that the bubbles leak out between the plug body attachment portion of the container and the shoulder member.

DESCRIPTION OF THE EMBODIMENTS

An embodiment of the disclosure provides a plug body which, when attached to a container and having been tilted by a certain amount or more or completely rolled over, can reduce the possibility that a content of a container leaks out upon pressure release, and can also reduce the possibility that a pressure release valve does not operate as specified.

Hereinafter the embodiment of the disclosure will be described in detail with reference to the drawings.

Configuration of Beverage Container According to the Embodiment of the Disclosure As shown in FIG. 1, FIG. 2, FIG. 4, and FIG. 5, a beverage container 10 according to the embodiment of the disclosure is composed of a double-layer vacuum container 200, a plug body 100, a second packing PK2, and a strap 300. Hereinafter, these components will be described in detail. The beverage container 10 is assembled by attaching the plug body 100 to the double-layer vacuum container 200.

1. Double-Layer Vacuum Container

Figure 4:
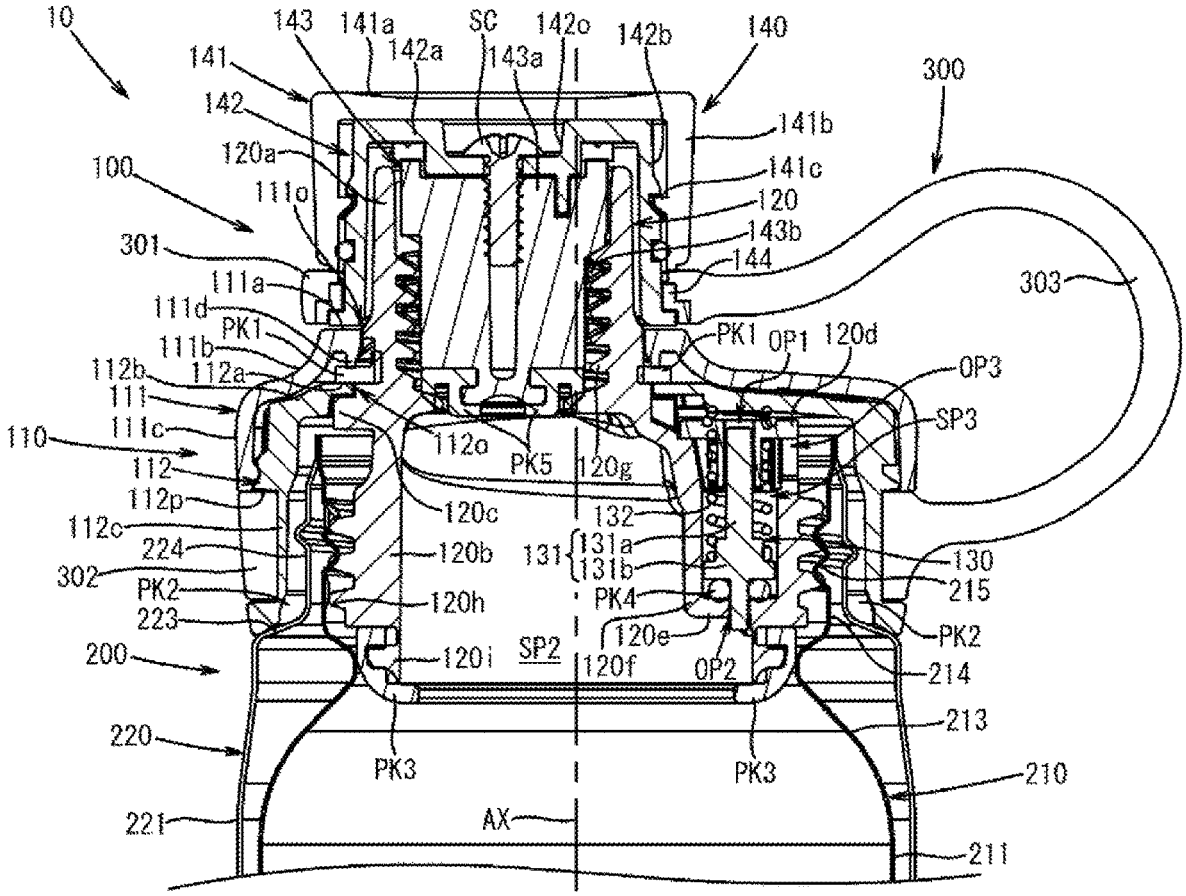
FIG. 4 is a cross-sectional view taken along line A-A of FIG. 3. In this figure, illustration of a double-layer vacuum container is partially omitted, and a state in which the pressure adjustment mechanism is not acting is shown.
Figure 5:
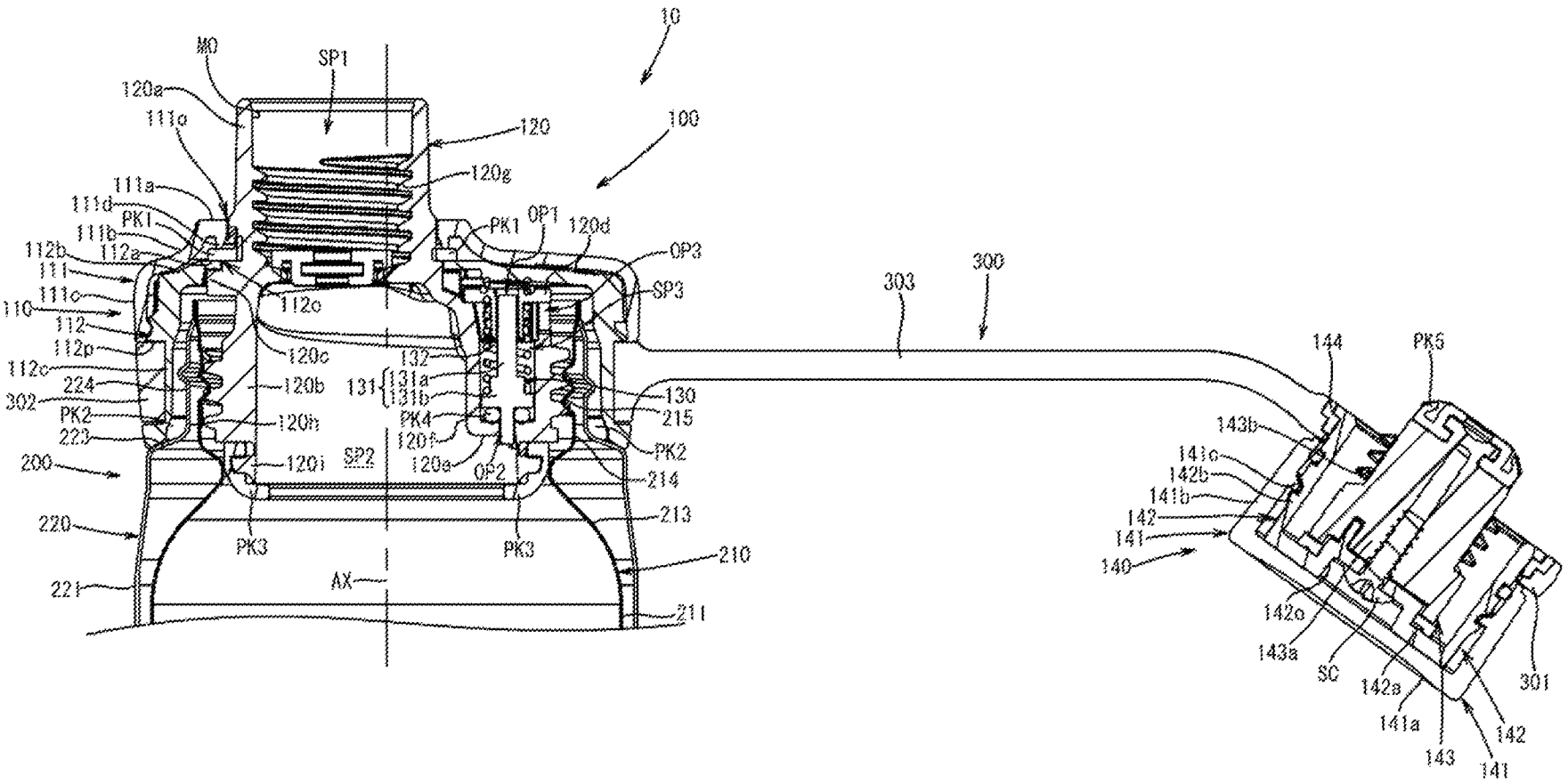
FIG. 5 is a cross-sectional view taken along line A-A in FIG. 3 when the outlet of the cylindrical wall part is not blocked by the plug. In this figure, illustration of the double-layer vacuum container is partially omitted, and a state in which the pressure adjustment mechanism is not acting is shown.

The double-layer vacuum container 200 is a container made of metal such as stainless steel, and as shown in FIG. 1, FIG. 2, FIG. 4, and FIG. 5, is mainly formed of an inner cylinder 210 and an outer cylinder 220. Specifically, as shown in FIG. 4 to FIG. 6, after an upper end portion of a tip wall part 214 (to be described later) of the inner cylinder 210 and an upper end portion of a tip wall part 224 (to be described later) of the outer cylinder 220 are joined together so that a heat insulating space is formed between the inner cylinder 210 and the outer cylinder 220, a vacuum state is created in the heat insulating space, and the double-layer vacuum container 200 is thus formed.

Figure 6:
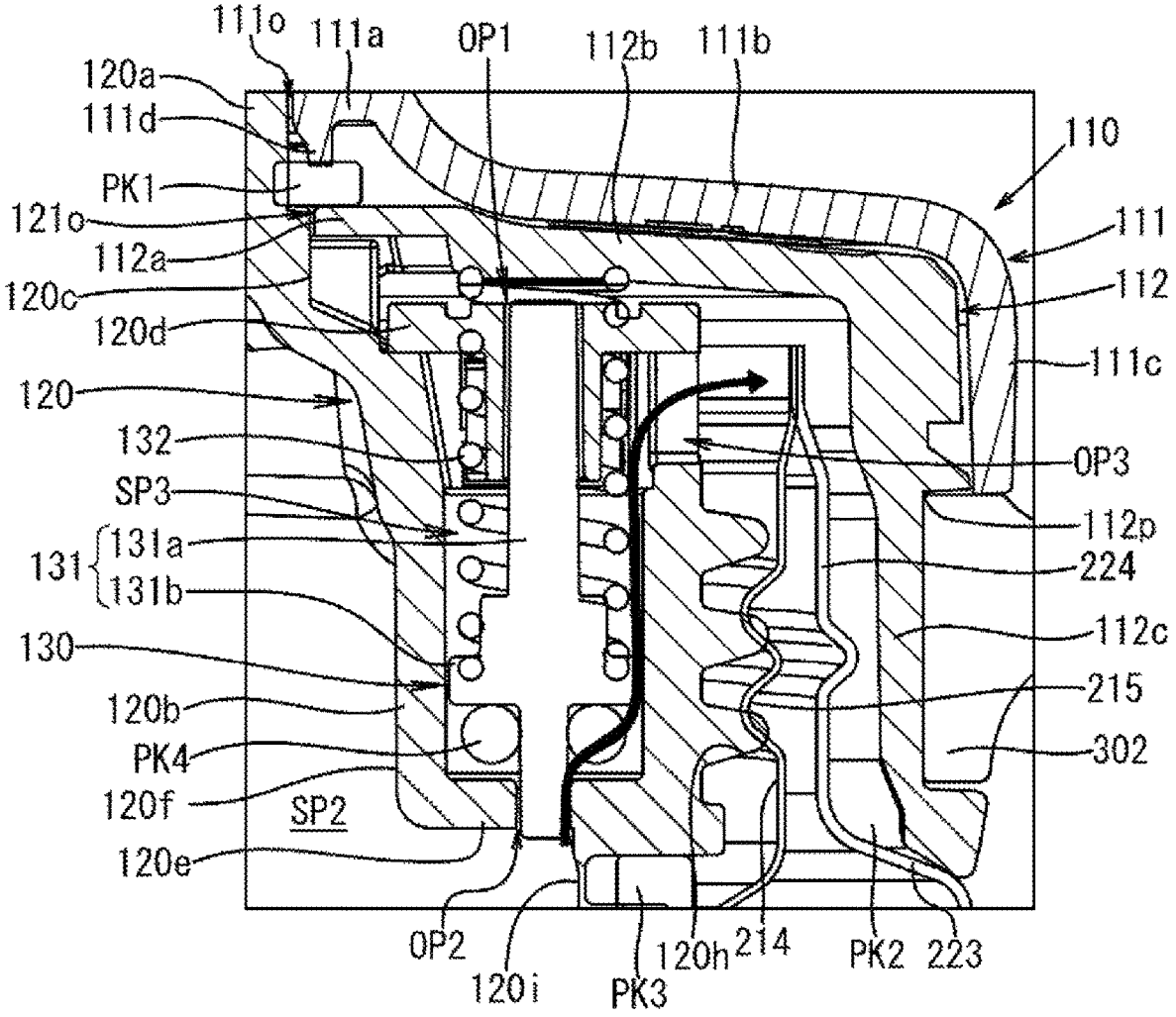
FIG. 6 is an enlarged cross-sectional view of the vicinity of the pressure adjustment mechanism according to the embodiment of the disclosure. In this figure, a state in which the pressure adjustment mechanism is acting is shown.
Figure 7:
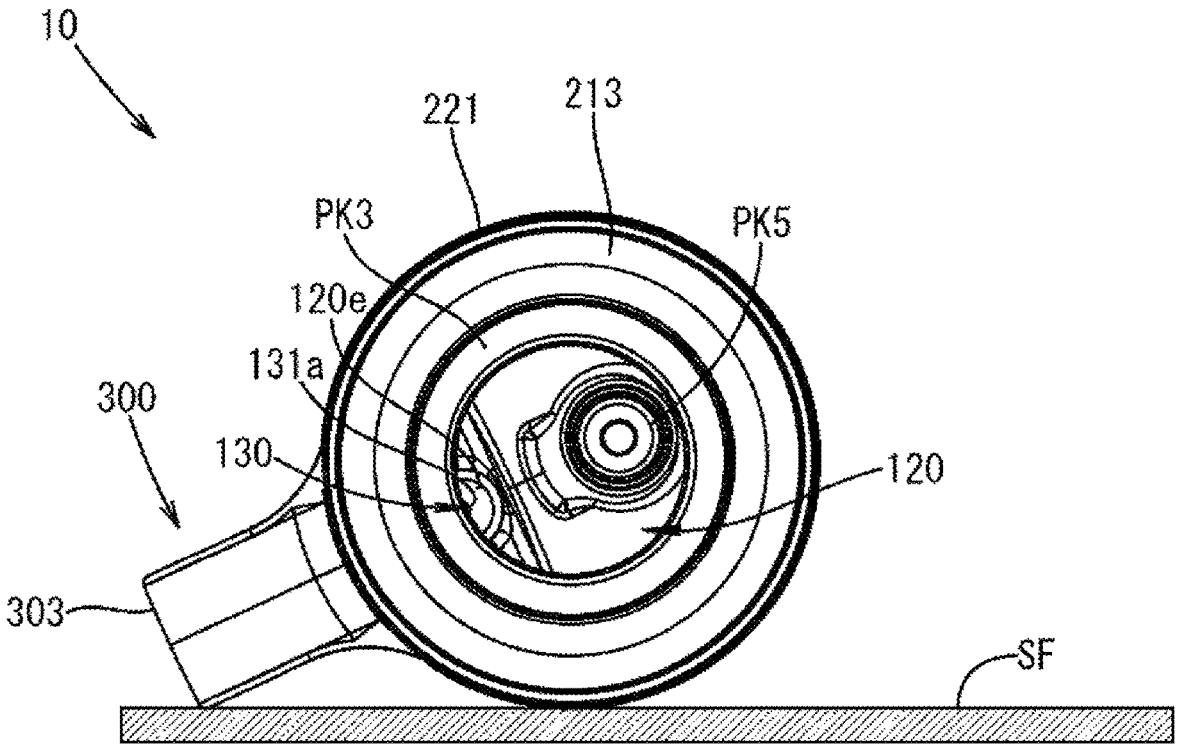
FIG. 7 is a view of an example of the beverage container when rolled over according to the embodiment of the disclosure. In this figure, the beverage container is cut at a height slightly below a step part of an inner cylinder in the beverage container in the state shown in FIG. 1.

As shown in FIG. 4 to FIG. 6, the inner cylinder 210 is mainly formed of an inner cylinder sidewall part 211, an inner cylinder bottom wall part (not shown), a step part 213, a tip wall part 214, and a female threaded part 215. The inner cylinder sidewall part 211 has a substantially cylindrical shape. The inner cylinder bottom wall part has a central portion spherically raised toward an opening side (upper side) and a corner portion having a recessed arc shape. The inner cylinder bottom wall part is formed at a lower side of the inner cylinder sidewall part 211. The step part 213 is a portion having a truncated cone shape (conical frustum shape), and as shown in FIG. 4, FIG. 5, and FIG. 7, is formed between the inner cylinder sidewall part 211 and the tip wall part 214 and connects the inner cylinder sidewall part 211 and the tip wall part 214. The tip wall part 214 has a substantially cylindrical shape, and as shown in FIG. 4 to FIG. 6, extends upward from an upper end portion of the step part 213. As shown in FIG. 4 to FIG. 6, the female threaded part 215 is formed on an inner peripheral surface of the tip wall part 214 and may be screwed with a male threaded part **120*h* (to be described later) of a cylindrical wall part 120 of the plug body 100**.

Figure 1:
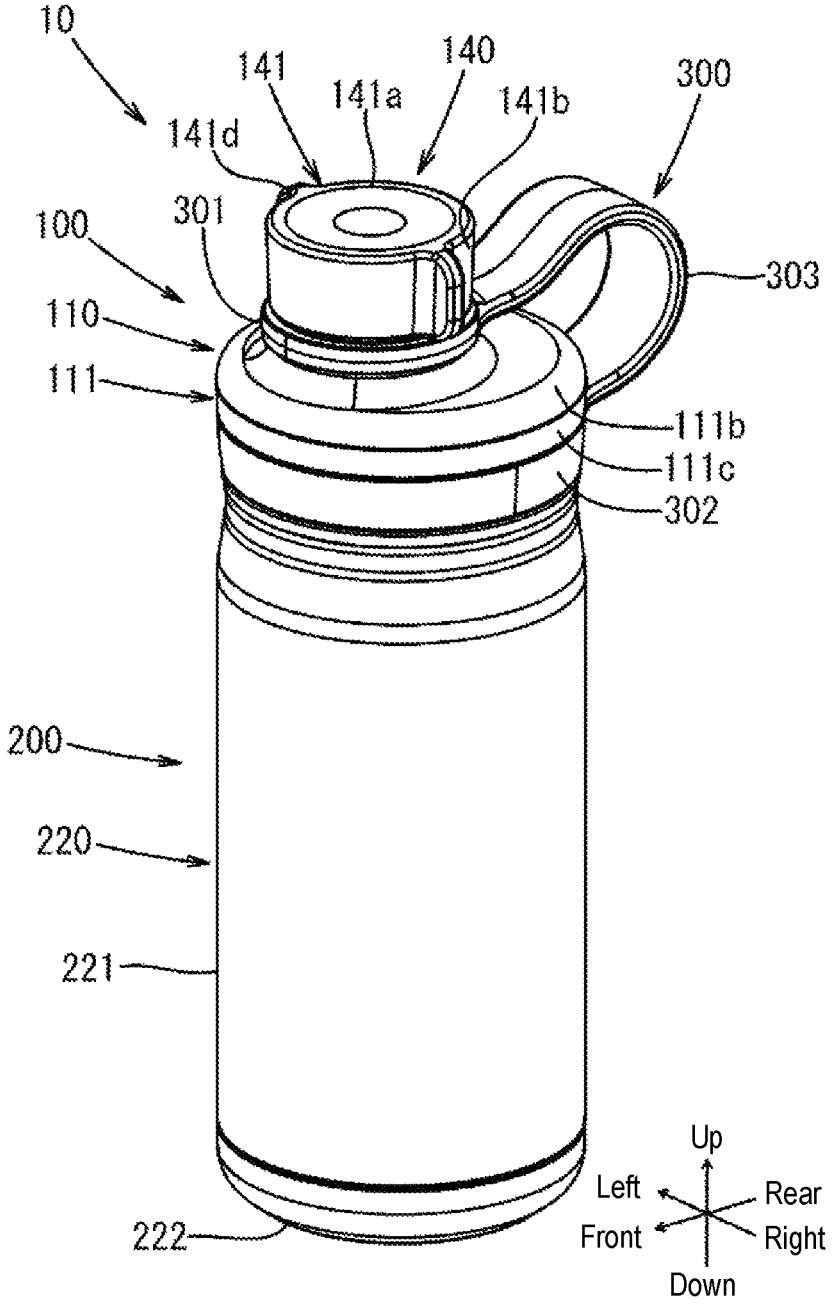
FIG. 1 is a perspective view of a beverage container according to an embodiment of the disclosure. In this figure, an outlet of a cylindrical wall part is blocked by a plug.
Figure 2:
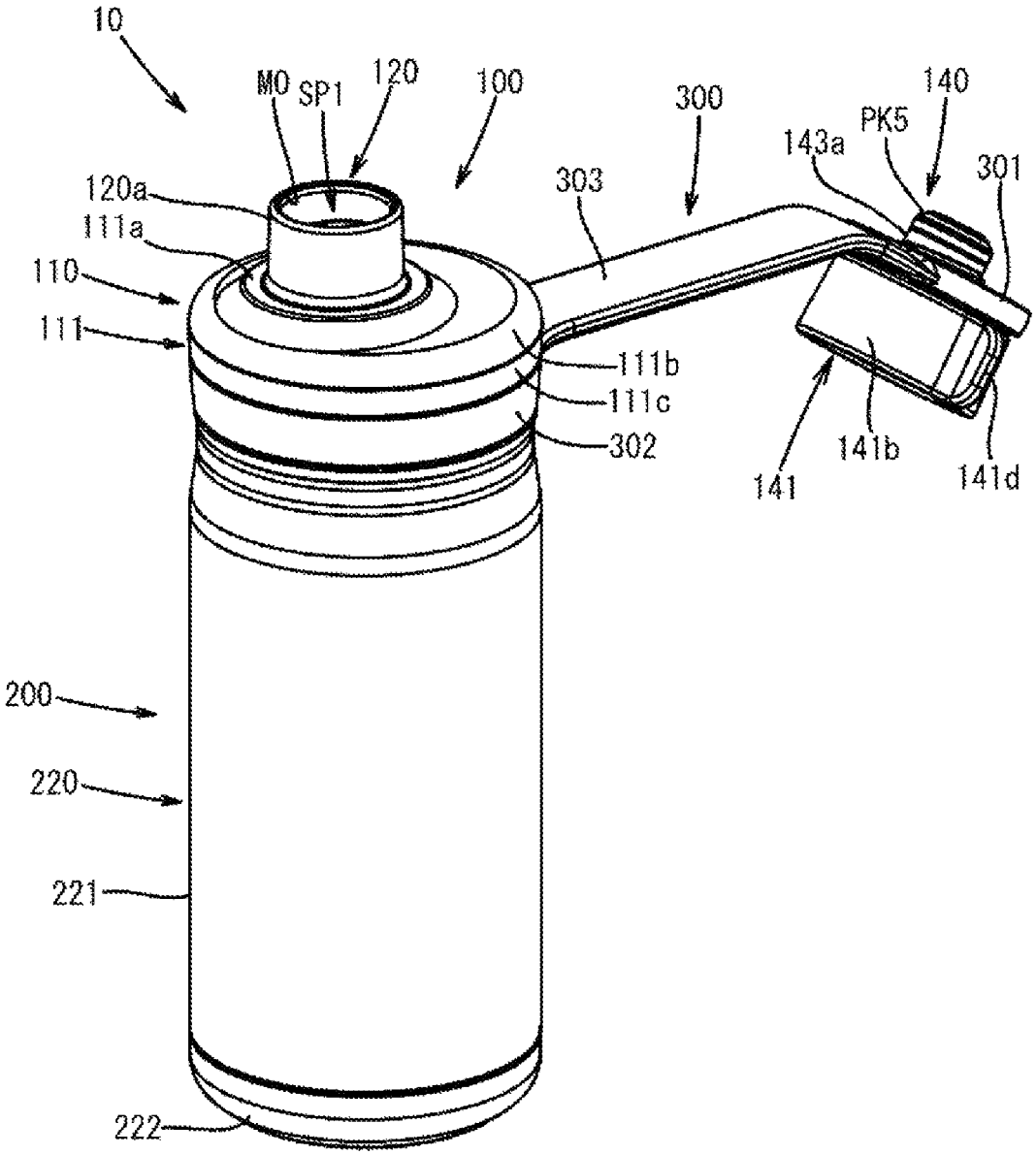
FIG. 2 is a perspective view of the beverage container according to the embodiment of the disclosure. In this figure, the outlet of the cylindrical wall part is not blocked by the plug.

As shown in FIG. 1, FIG. 2, and FIG. 4 to FIG. 6, the outer cylinder 220 is mainly formed of an outer cylinder sidewall part 221, an outer cylinder bottom wall part 222, a step part 223, and a tip wall part 224. The outer cylinder sidewall part 221 has a substantially cylindrical shape similar to the inner cylinder sidewall part 211. The outer cylinder bottom wall part 222 has a substantially disk shape, and as shown in FIG. 1 and FIG. 2, is joined with a lower end portion of the outer cylinder sidewall part 221. The step part 223 is a portion having a truncated cone shape (conical frustum shape), and as shown in FIG. 4 to FIG. 6, is formed between the outer cylinder sidewall part 221 and the tip wall part 224 and connects the outer cylinder sidewall part 221 and the tip wall part 224. The tip wall part 224 has a substantially cylindrical shape, and as shown in FIG. 4 to FIG. 6, extends upward from an upper end portion of the step part 223. As shown in FIG. 4 to FIG. 6, the second packing PK2 (to be described later) is attached to a recess formed by the step part 223 and the tip wall part 224.

2. Plug Body

As shown in FIG. 1 to FIG. 5, the plug body 100 is mainly composed of a shoulder member 110, a cylindrical wall part 120, a pressure adjustment mechanism 130, and a plug 140. Hereinafter, these components will be described in detail.

(1) Shoulder Member

The shoulder member 110 is a member formed of a resin or the like, and as shown in FIG. 1 to FIG. 6, covers the pressure adjustment mechanism 130 and is mainly composed of an outer shoulder member 111 and an inner shoulder member 112. Hereinafter, these components will be described in detail.

(1-1) Outer Shoulder Member

As shown in FIG. 1 to FIG. 6, the outer shoulder member 111 is mainly formed of a top wall part 111*a*, a step part 111*b*, a sidewall part 111*c*, and a claw part 111*d*. The top wall part 111*a* is a substantially disk-shaped portion constituting an upper wall of the outer shoulder member 111, and as shown in FIG. 2 and FIG. 4 to FIG. 6, an opening 1110 in a circular shape is formed at a central portion. As shown in FIG. 4, an upper sidewall part 120*a* of the cylindrical wall part 120 is inserted into the opening 111*o*. As shown in FIG. 1 to FIG. 6, the step part 111*b* is formed between the top wall part 111*a* and the sidewall part 111*c* and connects the top wall part 111*a* and the sidewall part 111*c*. The sidewall part 111*c* has a substantially cylindrical shape, and as shown in FIG. 1, FIG. 2, and FIG. 4 to FIG. 6, extends downward from a lower end portion of the step 111*b* to an upper end position of a recess 112*p* of a sidewall part 112*c* of the inner shoulder member 112. As shown in FIG. 4 to FIG. 6, the claw part 111*d* is a protrusion extending downward from an inner edge portion (i.e., a circumferential portion of the opening 111*o*) of the top wall part 111*a*, and clamps a first packing PK1 (to be described later) in cooperation with a top wall part 112*a* (to be described later) of the inner shoulder member 112.

(1-2) Inner Shoulder Member

As shown in FIG. 4 to FIG. 6, the inner shoulder member 112 is mainly formed of a top wall part 112*a*, a step part 112*b*, and a sidewall part 112*c*. The top wall part 112*a* is a substantially disk-shaped portion constituting an upper wall of the inner shoulder member 112, and as shown in FIG. 4 to FIG. 6, an opening 112*o* in a circular shape is formed at a central portion. As shown in FIG. 4, the upper sidewall part 120*a* of the cylindrical wall part 120 is inserted into the opening 112*o*. As shown in FIG. 4 to FIG. 6, a diameter of the opening 112*o* is slightly larger than a diameter of the opening 1110 of the outer shoulder member 111, and in a plan perspective view, a region of the opening 112*o* overlaps with an entire region of the opening 1110 of the outer shoulder member 111. Further, in a plan view, a center of the opening 112*o* is located at the same position as a center of the opening 1110 of the outer shoulder member 111. As shown in FIG. 4 to FIG. 6, the step part 112*b* is formed between the top wall part 112*a* and the sidewall part 112*c* and connects the top wall part 112*a* and the sidewall part 112*c*. The sidewall part 112*c* has a substantially cylindrical shape, and as shown in FIG. 4 to FIG. 6, extends downward from a lower end portion of the step part 112*b*. As shown in FIG. 4 to FIG. 6, a recess 112*p* in a ring shape recessed inward is formed from a lower portion to a middle portion of the sidewall part 112*c*. A large ring part 302 (to be described later) of the strap 300 is fitted into the recess 112*p*.

(2) Cylindrical Wall Part

The cylindrical wall part 120 is a member formed of a resin or the like, and as shown in FIG. 2 and FIG. 4 to FIG. 6, has a portion protruding upward through the opening 1110 of the outer shoulder member 111 and the opening 112*o* of the inner shoulder member 112, and is mainly formed of an upper sidewall part 120*a*, a lower sidewall part 120*b*, a collar part 120*c*, an upper containment wall part 120*d*, a lower containment wall part 120*e*, a front containment wall part 120*f*, a female threaded part 120*g*, a male threaded part 120*h*, and a third packing attachment wall part 120*i*. Further, as shown in FIG. 4 to FIG. 6, the first packing PK1 and the third packing PK3 are attached to the cylindrical wall part 120. The upper sidewall part 120*a* has a substantially cylindrical shape. As shown in FIG. 2, FIG. 4, and FIG. 5, the female threaded part 120*g* is formed from a lower portion to a middle portion of an inner peripheral surface of the upper sidewall part 120*a*. Further, as shown in FIG. 2 and FIG. 5, an internal space SP1 of the upper sidewall part 120*a* functions as a beverage passage together with an internal space SP2 (to described later), and the upper sidewall part 120*a* functions as a spout as an opening at an upper side of the upper sidewall part 120*a* becomes an outlet MO of the beverage. The lower sidewall part 120*b* has a substantially cylindrical shape. As shown in FIG. 4 and FIG. 5, the male threaded part 120*h* is formed from a lower portion to a middle portion of an outer peripheral surface of the lower sidewall part 120*b*. Further, as shown in FIG. 4 and FIG. 6, a notch is formed at an upper end portion on a rear side of the lower sidewall part 120*b*, and an opening OP3 is formed by arranging the upper containment wall part 120*d* on an upper side of the notch. As shown in FIG. 4 to FIG. 6, the collar part 120*c* extends outward and inward from a boundary between the upper sidewall part 120*a* and the lower sidewall part 120*b* and supports the top wall part 112*a* of the inner shoulder member 112. The upper containment wall part 120*d* has a substantially disk shape, and as shown in FIG. 4 to FIG. 6, is formed on an upper side of a rear portion of the lower sidewall part 120*b*. As shown in FIG. 4 to FIG. 6, an opening OP1 is formed at a central portion of the upper containment wall part 120*d*. The lower containment wall part 120*e* has a substantially disk shape, and as shown in FIG. 4 to FIG. 6, is formed on a lower side of the rear portion of the lower sidewall part 120*b*. As shown in FIG. 4 to FIG. 6, an opening OP2 is formed at a central portion of the lower containment wall part 120*e*. The front containment wall part 120*f* has a partial circular shape in a plan view, and as shown in FIG. 4 to FIG. 6, extends upward from a front edge portion of the lower containment wall part 120*e*. Herein, as shown in FIG. 4 to FIG. 6, a cylindrical portion having an internal space SP3 is formed by the lower sidewall part 120*b*, the upper containment wall part 120*d*, the lower containment wall part 120*e*, and the front containment wall part 120*f*. As shown in FIG. 4 to FIG. 6, the internal space SP3 extends in the vertical direction. Further, as shown in FIG. 4 to FIG. 6, the pressure adjustment mechanism 130 (to be described later) is arranged in the internal space SP3. As described above, the female threaded part 120*g* is formed from the lower portion to the middle portion of the inner peripheral surface of the upper sidewall part 120*a* and may be screwed with a male threaded part 143*b* (to be described later) of the plug 140. As described above, the male threaded part 120*h* is formed from the lower portion to the middle portion of the outer peripheral surface of the lower sidewall part 120*b* and may be screwed with the female threaded part 215 of the inner cylinder 210. The third packing attachment wall part 120*i* has a substantially cylindrical shape, and as shown in FIG. 4 to FIG. 6, is formed on a lower side of the lower sidewall part 120*b*. Herein, as shown in FIG. 4 to FIG. 6, the internal space SP2 is formed by the lower sidewall part 120*b*, the lower containment wall part 120*e*, the front containment wall part 120*f*, and the third packing attachment wall part 120*i*. The internal space SP2 functions as a beverage passage together with the internal space SP1 of the upper sidewall part 120*a*, and also functions as a space for retaining air on an upper side of the beverage when the plug body 100 is attached to the double-layer vacuum container 200 and the beverage is poured into the double-layer vacuum container 200. The first packing PK1 is a ring-shaped member formed of an elastic material such as rubber or an elastomer, and as shown in FIG. 4 to FIG. 6, is attached to a lower portion of an outer peripheral surface of the upper sidewall part 120*a* of the cylindrical wall part 120. Further, as described above, the first packing PK1 is clamped between the claw part 111*d* of the outer shoulder member 111 of the shoulder member 110 and the top wall part 112*a* of the inner shoulder member 112 of the shoulder member 110. Herein, the first packing PK1 serves to close a gap between the outer shoulder member 111 of the shoulder member 110 and the upper sidewall part 120*a* of the cylindrical wall part 120, and close a gap between the inner shoulder member 112 of the shoulder member 110 and the upper sidewall part 120*a* of the cylindrical wall part 120. The third packing PK3 is a ring-shaped member formed of an elastic material such as rubber or an elastomer, and as shown in FIG. 4 to FIG. 7, is attached to an outer peripheral surface of the third packing attachment wall part 120*i*. Herein, when the male threaded part 120*h* is screwed with the female threaded part 215 of the inner cylinder 210 of the double-layer vacuum container 200, the third packing PK3 is in contact with the upper end portion of the step part 213 of the inner cylinder 210, as shown in FIG. 4 and FIG. 5. In such a case, the third packing PK3 serves to close a gap between the cylindrical wall part 120 and the inner cylinder 210.

(3) Pressure Adjustment Mechanism

The pressure adjustment mechanism 130 is a member for adjusting an internal pressure of the beverage container 10, and as shown in FIG. 4 to FIG. 6, is arranged in the internal space SP3 of the cylindrical wall part 120 and is mainly composed of a valve body 131, an urging member 132, and a fourth packing PK4. Hereinafter, these components will be described in detail.

(3-1) Valve Body

As shown in FIG. 4 to FIG. 6, the valve body 131 is mainly formed of a valve rod 131*a* and a valve part 131*b*. As shown in FIG. 4 to FIG. 6, the valve rod 131*a* is a rod member having a substantially columnar shape extending in the vertical direction. Herein, as shown in FIG. 4 to FIG. 6, the valve rod 131*a* is inserted inside the urging member 132, and an upper end portion of the valve rod 131*a* is inserted through the opening OP1 of the upper containment wall part 120*d* of the cylindrical wall part 120. On the other hand, a lower end portion of the valve rod 131*a* is inserted through the opening OP2 of the lower containment wall part 120*e* of the cylindrical wall part 120. A slight gap is formed between the lower end portion of the valve rod 131*a* and the opening OP2. As shown in FIG. 4 to FIG. 6, the valve part 131*b* is a substantially columnar portion formed at the lower end portion of the valve rod 131*a* and is urged toward a lower side (i.e., the opening OP2 side) by the urging member 132 (as a result, the valve rod 131*a* is also urged toward the lower side by the urging member 132). In a plan view, a diameter of the valve part 131*b* is designed to be larger than an outer diameter of the fourth packing PK4. Further, in the internal space SP3, a slight gap is formed between the valve part 131*b* and the lower sidewall part 120*b* and the front containment wall part 120*f* of the cylindrical wall part 120.

(3-2) Urging Member

The urging member 132 is a coil spring for urging the valve body 131 downward. As shown in FIG. 4 to FIG. 6, one end of the urging member 132 is fitted into the upper containment wall part 120*d* of the cylindrical wall part 120, and another end of the urging member 132 is in contact with the valve part 131*b* of the valve body 131.

(3-3) Fourth Packing

The fourth packing PK4 is a ring-shaped member formed of an elastic material such as rubber or an elastomer. Further, as shown in FIG. 4 to FIG. 6, the fourth packing PK4 is attached to a lower surface of the valve part 131*b* of the valve body 131 so that a lower portion of the valve rod 131*a* of the valve body 131 passes through a central opening of the fourth packing PK4. Herein, as shown in FIG. 4, when the valve body 131 is urged downward by the urging member 132, the fourth packing PK4 is in contact with an upper surface of the lower containment wall part 120*e* of the cylindrical wall part 120 and blocks the opening OP2 of the lower containment wall part 120*e* of the cylindrical wall part 120 together with the valve body 131.

In the plug body 100 according to the embodiment of the disclosure, a mass of a front side portion is designed to be larger than a mass of a rear side portion. Specifically, this design is realized by making a mass of the upper sidewall part 120*a* of the cylindrical wall part 120 larger than a mass of the pressure adjustment mechanism 130. With this design, when the plug body 100 is attached to the double-layer vacuum container 200, in the beverage container 10, a mass on a front side of a cylinder axis line AX (referring to FIG. 3 to FIG. 5, a virtual line extending in the vertical direction from centers of the inner cylinder bottom wall part of the inner cylinder 210 and the outer cylinder bottom wall part 222 of the outer cylinder 220) of the double-layer vacuum container 200 is larger than a mass on a rear side of the cylinder axis line AX. In other words, when the plug body 100 is attached to the double-layer vacuum container 200, if the beverage container 10 is tilted by a certain amount or more or rolled over, the pressure adjustment mechanism 130 will be located above the cylindrical wall part 120. At this time, if the beverage has been poured into the double-layer vacuum container 200, the beverage flows into the internal space SP2, and the air stored in the internal space SP2 moves to the pressure adjustment mechanism 130 side. Further, as shown in FIG. 4 and FIG. 5, the pressure adjustment mechanism 130 is located on an opposite side of portions, except a rear portion, of the upper sidewall part 120*a* of the cylindrical wall part 120 across the cylinder axis line AX of the double-layer vacuum container 200.

(4) Plug

The plug 140 is a member for blocking the outlet MO of the upper sidewall part 120*a* of the cylindrical wall part 120, and as shown in FIG. 1 to FIG. 5, is mainly composed of an upper cover member 141, a lower cover member 142, a plug main body part 143, and a rotating ring 144. Hereinafter, these components will be described in detail. As shown in FIG. 2 and FIG. 5, when the plug 140 does not block the outlet MO of the upper sidewall part 120*a* of the cylindrical wall part 120, the plug 140 may be located on a rear side (rear side of the double-layer vacuum container 200) of the shoulder member 110 due to the strap 300.

(4-1) Upper Cover Member

The upper cover member 141 is a member formed of a resin or the like, and as shown in FIG. 1 to FIG. 5, is mainly formed of a top wall part 141*a*, a sidewall part 141*b*, a claw part 141*c*, and a handle part 141*d*. As shown in FIG. 1 to FIG. 5, the top wall part 141*a* has a substantially disk shape.

Figure 3:
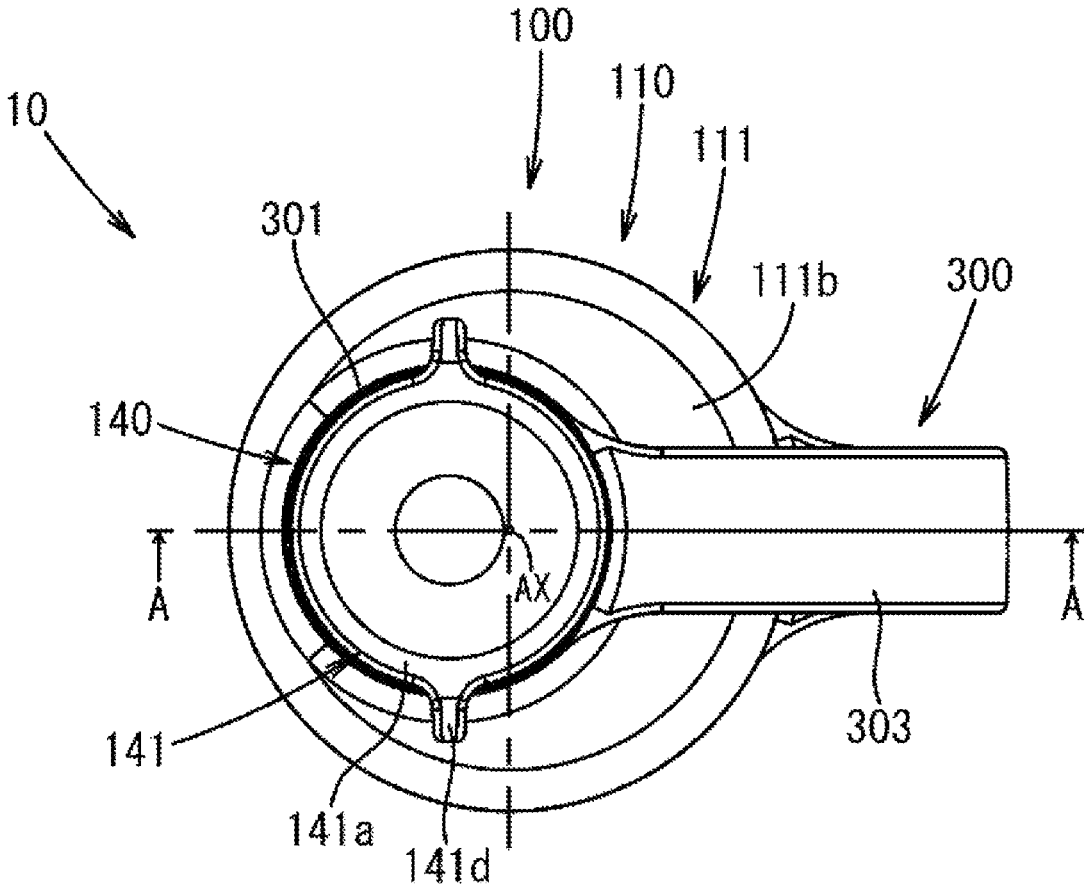
FIG. 3 is a plan view of the beverage container according to the embodiment of the disclosure. In this figure, the outlet of the cylindrical wall part is blocked by the plug.

As shown in FIG. 1, FIG. 2, FIG. 4, and FIG. 5, the sidewall part 141*b* has a substantially cylindrical shape and extends downward from an outer edge portion of the top wall part 141*a*. As shown in FIG. 4 and FIG. 5, the claw part 141*c* extends inward from a middle portion of an inner peripheral surface of the sidewall part 141*b* and is fitted into a recess formed at a middle portion of an outer peripheral surface of a sidewall part 142*b* of the lower cover member 142. The handle part 141*d* is used by the user when turning the upper cover member 141, and as shown in FIG. 1 to FIG. 3, extends outward from an outer peripheral surface of the sidewall part 141*b* on a diameter line passing through a center of the top wall part 141*a*.

(4-2) Lower Cover Member

The lower cover member 142 is a member formed of a resin or the like, and as shown in FIG. 4 and FIG. 5, is mainly formed of a top wall part 142*a* and a sidewall part 142*b*. As shown in FIG. 4 and FIG. 5, the top wall part 142*a* has a substantially disk shape. As shown in FIG. 4 and FIG. 5, a recess 142*o* recessed downward is formed at a central portion of the top wall part 142*a*, and an opening is formed at a central portion of the recess 142*o*. Then, as shown in FIG. 4 and FIG. 5, the lower cover member 142 and the plug main body part 143 are fastened by passing a screw SC through this opening and an insertion hole (to be described later) of the plug main body part 143. As shown in FIG. 4 and FIG. 5, the sidewall part 142*b* has a substantially cylindrical shape and extends downward from an outer edge portion of the top wall part 142*a*. As described above, a recess is formed at the middle portion of the outer peripheral surface of the sidewall part 142*b*, and the claw part 141*c* of the upper cover member 141 is fitted thereto.

(4-3) Plug Main Body Part

The plug main body part 143 is a member detachably attached to the internal space SP1 of the cylindrical wall part 120, and as shown in FIG. 4 and FIG. 5, is formed of a main body part 143*a*, a male threaded part 143*b*, and a fifth packing PK5. The main body part 143*a* is formed of a resin or the like, and as shown in FIG. 2, FIG. 4, and FIG. 5, has a substantially columnar shape. As shown in FIG. 4 and FIG. 5, the main body part 143*a* is formed with an insertion hole extending downward from a central portion of an upper wall part of the main body part 143*a*. As described above, the lower cover member 142 and the plug main body part 143 are fastened by passing the screw SC through this insertion hole and the opening of the top wall part 142*a* of the lower cover member 142. The male threaded part 143*b* is formed of a resin or the like, and as shown in FIG. 4 and FIG. 5, is formed at a middle portion of an outer peripheral surface of the main body part 143*a* and may be screwed with the female threaded part 120*g* of the cylindrical wall part 120 except for a lower portion of the female threaded part 120*g* of the cylindrical wall part 120 (in other words, the male threaded part 143*b* does not reach the lower portion of the female threaded part 120*g* of the cylindrical wall part 120 when screwing with the female threaded part 120*g* of the cylindrical wall part 120). The fifth packing PK5 is a ring-shaped member formed of an elastic material such as rubber or an elastomer, and as shown in FIG. 2, FIG. 4, FIG. 5, and FIG. 7, is attached to a lower end portion of the main body part 143*a*. Herein, when the male threaded part 143*b* is screwed with the female threaded part 120*g* of the cylindrical wall part 120, the fifth packing PK5 is in contact with the collar part 120*c* of the cylindrical wall part 120 and serves to close a gap between the main body part 143*a* and the cylindrical wall part 120.

(4-4) Rotating Ring

The rotating ring 144 has a substantially ring shape, and as shown in FIG. 4 and FIG. 5, is attached to a lower end portion of an outer peripheral surface of the sidewall part 142*b* of the lower cover member 142 and is rotatable with respect to the sidewall part 142*b* of the lower cover member 142. In other words, when the upper cover member 141 is turned by the user in order to release the blocked state of the outlet MO of the upper sidewall part 120*a* of the cylindrical wall part 120 blocked by the plug 140 (the lower cover member 142 and the plug main body part 143 also rotate along with the upper cover member 141), the rotating ring 144 does not rotate together with the upper cover member 141, the lower cover member 142, and the plug main body part 143. Further, as shown in FIG. 4 and FIG. 5, a small ring part 301 (to be described later) of the strap 300 is attached to an outer peripheral surface of the rotating ring 144.

3. Second Packing

The second packing PK2 is a ring-shaped member formed of an elastic material such as rubber or an elastomer, and as described above, is attached to the recess formed by the step part 223 of the outer cylinder 220 and the tip wall part 224 of the outer cylinder 220. Herein, as shown in FIG. 4 to FIG. 6, when the male threaded part 120*h* of the cylindrical wall part 120 is screwed with the female threaded part 215 of the inner cylinder 210, the second packing PK2 is in contact with the inner shoulder member 112 of the shoulder member 110. In such a case, the second packing PK2 serves to close a gap between the inner shoulder member 112 of the shoulder member 110 and the outer cylinder 220.

4. Strap

The strap 300 is a member capable of connecting the shoulder member 110 and the plug 140 even after the blocked state of the outlet MO of the upper sidewall part 120*a* of the cylindrical wall part 120 blocked by the plug 140 is released (in other words, even after the plug 140 is removed from the cylindrical wall part 120), and is formed of an elastic material such as rubber or an elastomer. As shown in FIG. 1 to FIG. 5, the strap 300 is mainly formed of a small ring part 301, a large ring part 302, and a bridge part 303. As shown in FIG. 1 to FIG. 5, the small ring part 301 has a substantially ring shape and is attached to the outer peripheral surface of the rotating ring 144 of the plug 140. Accordingly, the small ring part 301 becomes rotatable together with the rotating ring 144 with respect to the sidewall part 142*b* of the lower cover member 142 of the plug 140. As shown in FIG. 1, FIG. 2, and FIG. 4 to FIG. 6, the large ring part 302 has a substantially ring shape and is fitted into the recess 112*p* of the inner shoulder member 112 of the shoulder member 110. At this time, as shown in FIG. 1, FIG. 2, FIG. 4, and FIG. 5, a boundary between the large ring part 302 and the bridge part 303 is located on a rear side of the inner shoulder member 112 of the shoulder member 110, and the large ring part 302 is non-rotatable with respect to the inner shoulder member 112 of the shoulder member 110. As shown in FIG. 1 to FIG. 5, the bridge part 303 serves to connect the small ring part 301 and the large ring part 302. Further, as shown in FIG. 1 and FIG. 4, when the outlet MO of the upper sidewall part 120*a* of the cylindrical wall part 120 is blocked by the plug 140, the bridge part 303 is deformed into a substantially arc shape, so that it also serves as a handle for carrying.

If the strap 300 is not present in the beverage container 10, when the plug body 100 is attached to the double-layer vacuum container 200 and the beverage container 10 is tilted by a certain amount or more or rolled over, depending on how it is tilted and rolled over, the pressure adjustment mechanism 130 may temporarily come completely to the lower side (in other words, a distance between the pressure adjustment mechanism 130 and a surface SF (see FIG. 7) may temporarily be the smallest). However, with the strap 300 being present in the beverage container 10, as shown in FIG. 7, it is possible to reduce the possibility that the pressure adjustment mechanism 130 comes completely to the lower side (in other words, the distance between the pressure adjustment mechanism 130 and the surface SF is the smallest).

<Use Method of Plug Body and Operation Mode Thereof>

First, a desired beverage is poured into the double-layer vacuum container 200. Next, after screwing the male threaded part 120*h* of the cylindrical wall part 120 of the plug body 100 into the female threaded part 215 of the double-layer vacuum container 200, the beverage container 10 is completed by screwing the male threaded part 143*b* of the plug 140 of the plug body 100 into the female threaded part 120*g* of the cylindrical wall part 120 of the plug body 100 (see FIG. 1 and FIG. 4). Alternatively, after screwing the male threaded part 143*b* of the plug 140 of the plug body 100 into the female threaded part 120*g* of the cylindrical wall part 120 of the plug body 100, the beverage container 10 is completed by screwing the male threaded part 120*h* of the cylindrical wall part 120 of the plug body 100 into the female threaded part 215 of the double-layer vacuum container 200. At this time, as shown in FIG. 4, the third packing PK3 is in contact with the upper end portion of the step part 213 of the inner cylinder 210 of the double-layer vacuum container 200, and the fifth packing PK5 is in contact with the collar part 120*c* of the cylindrical wall part 120 of the plug body 100. Accordingly, the double-layer vacuum container 200 and the plug body 100 are kept watertight.

Further, as shown in FIG. 4, air is retained in the internal space SP2 of the cylindrical wall part 120. Then, when the user drinks the beverage in the beverage container 10, the screwed state between the female threaded part 120*g* of the cylindrical wall part 120 of the plug body 100 and the male threaded part 143*b* of the plug 140 of the plug body 100 is released. Next, the user grasps the double-layer vacuum container 200, lifts the beverage container 10, brings the cylindrical wall part 120 of the plug body 100 to the mouth, and drinks the beverage in the beverage container 10. In such a case, the beverage in the beverage container 10 flows into the user's mouth through the internal space SP2 and the internal space SP1 of the cylindrical wall part 120. Then, when the user finishes drinking the beverage in the beverage container 10, the user screws the male threaded part 143*b* of the plug 140 of the plug body 100 into the female threaded part 120*g* of the cylindrical wall part 120 of the plug body 100.

Next, with the beverage in the beverage container 10 being effervescent drinking water (e.g., a carbonated beverage, an alcoholic beverage, etc.), the male threaded part 120*h* of the cylindrical wall part 120 of the plug body 100 being screwed with the female threaded part 215 of the double-layer vacuum container 200, and the male threaded part 143*b* of the plug 140 of the plug body 100 being screwed with the female threaded part 120*g* of the cylindrical wall part 120 of the plug body 100 (see FIG. 1 and FIG. 4), the operation mode of the pressure adjustment mechanism 130 of the plug body 100 when the internal pressure in the beverage container 10 becomes high will be described. First, when the internal pressure in the beverage container 10 is not high, as shown in FIG. 4, in the pressure adjustment mechanism 130 of the plug body 100, the urging member 132 urges the valve body 131 and the fourth packing PK4 downward, and the valve body 131 and the fourth packing PK4 block the opening OP2 of the cylindrical wall part 120 of the plug body 100. Then, when a substance (e.g., carbon dioxide or the like) dissolved in the drinking water in the beverage container 10 is vaporized to become a gas and the internal pressure in the beverage container 10 becomes high, as shown in FIG. 6, in the pressure adjustment mechanism 130 of the plug body 100, the valve body 131 and the fourth packing PK4 move upward against the urging force of the urging member 132, and the blocked state of the opening OP2 of the cylindrical wall part 120 of the plug body 100 is released. Next, as indicated by a thick arrow in FIG. 6, the gas is discharged through the opening OP2 of the cylindrical wall part 120 of the plug body 100, the internal space SP3, and the opening OP3 of the cylindrical wall part 120 of the plug body 100. Then, when the internal pressure in the beverage container 10 returns to the original state, the valve body 131 and the fourth packing PK4 are urged downward by the urging member 132 to re-block the opening OP2 of the cylindrical wall part 120 of the plug body 100. When the gas is discharged through the opening OP2 of the cylindrical wall part 120 of the plug body 100, the internal space SP3, and the opening OP3 of the cylindrical wall part 120 of the plug body 100, bubbles or the like may also pass through the opening OP2 of the cylindrical wall part 120 of the plug body 100, but bubbles or the like are trapped by the internal space SP3. Even if bubbles or the like are discharged through the opening OP2 of the cylindrical wall part 120 of the plug body 100, the internal space SP3, and the opening OP3 of the cylindrical wall part 120 of the plug body 100, bubbles or the like are collected in the beverage container 10 by the first packing PK1 and the second packing PK2.

Characteristics of Plug Body According to the Embodiment of the Disclosure (1)

In the plug body 100 according to the embodiment of the disclosure, the mass of the front side portion is designed to be larger than the mass of the rear side portion, and further, the pressure adjustment mechanism 130 is arranged at the rear side portion of the plug body 100. Therefore, when the plug body 100, attached to the double-layer vacuum container 200, has been tilted by a certain amount or more or completely rolled over, it is possible to reduce the possibility that the beverage of the double-layer vacuum container 200 leaks out upon pressure release, and also, it is possible to reduce the possibility that the pressure adjustment mechanism 130 does not operate as specified.

(2)

In the plug body 100 according to the embodiment of the disclosure, the shoulder member 110 and the plug 140 are connected via the strap 300, the boundary between the large ring part 302 of the strap 300 and the bridge part 303 of the strap 300 is located on a rear side of the inner shoulder member 112 of the shoulder member 110, and the large ring part 302 of the strap 300 is non-rotatable with respect to the inner shoulder member 112 of the shoulder member 110. Therefore, in the plug body 100, when the plug body 100, attached to the double-layer vacuum container 200, has been tilted by a certain amount or more or completely rolled over, the strap 300 can reduce the possibility that the pressure adjustment mechanism 130 comes completely to the lower side. Accordingly, in the plug body 100, it is possible to reduce the possibility that the pressure adjustment mechanism 130 is immersed in the beverage of the double-layer vacuum container 200.

(3)

In the plug body 100 according to the embodiment of the disclosure, the internal space SP3 extending in the vertical direction is formed by the lower sidewall part 120*b*, the upper containment wall part 120*d*, the lower containment wall part 120*e*, and the front containment wall part 120*f* of the cylindrical wall part 120. Therefore, in the plug body 100, when not only gas but also bubbles or the like enter from the opening OP2 of the cylindrical wall part 120, the internal space SP3 can trap part or all of the bubbles, and it is possible to reduce the amount of bubbles leaking out of the plug body 100 or prevent the bubbles from leaking out of the plug body 100.

(4)

In the plug body 100 according to the embodiment of the disclosure, the shoulder member 110 covers the pressure adjustment mechanism 130. Therefore, in the plug body 100, the design property of the plug body 100 can be improved.

(5)

In the plug body 100 according to the embodiment of the disclosure, the valve body 131 of the pressure adjustment mechanism 130 is urged downward by the urging member 132 of the pressure adjustment mechanism 130. Therefore, in the plug body 100, the acting force of the urging member 132 of the pressure adjustment mechanism 130 can be controlled by simply changing the urging load of the urging member 132 of the pressure adjustment mechanism 130 according to the relationship "pressure=force/area".

(6)

In the plug body 100 according to the embodiment of the disclosure, the first packing PK1 closes the gap between the outer shoulder member 111 of the shoulder member 110 and the upper sidewall part 120*a* of the cylindrical wall part 120, and closes the gap between the inner shoulder member 112 of the shoulder member 110 and the upper sidewall part 120*a* of the cylindrical wall part 120. Further, in the beverage container 10 according to the embodiment of the disclosure, the second packing PK2 closes the gap between the inner shoulder member 112 of the shoulder member 110 and the outer cylinder 220. Therefore, not only can the first packing PK1 reduce the possibility that the bubbles leak out from the opening 1110 and the opening 112*o* of the shoulder member 110, but also the second packing PK2 can reduce the possibility that the bubbles leak out from between the inner shoulder member 112 of the shoulder member 110 and the outer cylinder 220.

MODIFICATION EXAMPLES (A)

The shape and constituent material of each part of the plug body 100 according to the above embodiment are not particularly limited, and each part may have any shape and may be formed of any material as long as it does not deviate from the gist of the disclosure. For example, in the plug body 100 according to the above embodiment, the shoulder member 110 and the cylindrical wall part 120 are formed of a resin or the like, but they may also be formed of metal or the like.

(B)

In the plug body 100 according to the above embodiment, the internal space SP2 is formed by the lower sidewall part 120*b*, the lower containment wall part 120*e*, the front containment wall part 120*f*; and the third packing attachment wall part 120*i* of the cylindrical wall part 120; the internal space SP3 is formed by the lower sidewall part 120*b*, the upper containment wall part 120*d*, the lower containment wall part 120*e*, and the front containment wall part 120*f* of the cylindrical wall part 120; and the shoulder member 110, the strap 300, the first packing PK1, the second packing PK2, and the like are provided. However, some or all of the parts and members thereof may be omitted.

(C)

In the plug body 100 according to the above embodiment, a spring type (a device that urges the valve body 131 downward by the urging member 132 which is a coil spring) is adopted as the pressure adjustment mechanism 130, but the pressure adjustment mechanism 130 is not limited to the spring type, and other types of pressure adjustment mechanism may also be adopted.

(D)

In the plug body 100 according to the above embodiment, the mass on the front side of the cylinder axis line AX of the double-layer vacuum container 200 is made larger than the mass on the rear side of the cylinder axis line AX by making the mass of the upper sidewall part 120*a* of the cylindrical wall part 120 larger than the mass of the pressure adjustment mechanism 130. However, the mass on the front side of the cylinder axis line AX of the double-layer vacuum container 200 may also be made larger than the mass on the rear side of the cylinder axis line AX by making the mass of a front side portion of another portion or member such as the lower sidewall part 120*b* of the cylindrical wall part 120 or the shoulder member 110 larger than the mass of a rear side portion.

(E)

In the plug body 100 according to the above embodiment, a male threaded type plug having the male threaded part 143*b* formed on the plug main body part 143 is adopted as the plug 140, but the plug 140 is not limited to the male threaded type, and other types of plug such as a female threaded type plug may also be adopted. When a female threaded type plug is adopted, it is preferable that a male threaded part is formed on the outer peripheral surface of the upper sidewall part 120*a* of the cylindrical wall part 120.

(F)

In the plug body 100 according to the above embodiment, the internal space SP3 extends in the vertical direction, but the formation direction of the internal space SP3 may also be any direction including a vertical direction component.

(G)

In the plug body 100 according to the above embodiment, in a plan view, the pressure adjustment mechanism 130 is opposed to portions, except the rear portion, of the upper sidewall part 120*a* of the cylindrical wall part 120 across the cylinder axis line AX of the double-layer vacuum container 200 (in other words, in a cross-sectional view, the pressure adjustment mechanism 130 is located on the opposite side of portions, except the rear portion, of the upper sidewall part 120*a* of the cylindrical wall part 120 across the cylinder axis line AX of the double-layer vacuum container 200). However, this relationship is not always necessary, and the arrangement positions of the upper sidewall part 120*a* of the cylindrical wall part 120 and the pressure adjustment mechanism 130 may be determined within a range that does not deviate from the gist of the disclosure. For example, in a plan view, the pressure adjustment mechanism 130 may also be opposed to all of the upper sidewall part 120*a* of the cylindrical wall part 120 across the cylinder axis line AX of the double-layer vacuum container 200.

(H)

In the beverage container 10 according to the above embodiment, a beverage (including an effervescent beverage) is poured into the double-layer vacuum container 200, but the content to be contained in the double-layer vacuum container 200 is not particularly limited.

(I)

In the above embodiment, the double-layer vacuum container 200 is adopted as the container, but the container is not particularly limited, and may also be, for example, a general single-walled container. Further, in the above embodiment, stainless steel is adopted as the material of the container, but the material of the container may also be an alloy other than stainless steel, a resin, or the like.

The above modification examples may be applied alone or in combination.

What is claimed is:

1. A plug body comprising:

a spout part;

a pressure release valve arranged at a position different from an arrangement position of the spout part; and a shoulder member which has an opening projecting toward the spout part and fully covers a top surface of the pressure release valve, wherein the pressure release valve comprises a valve body, and a ring-shaped member is disposed between a bottom surface of the valve body and a lower containment wall part of a cylindrical wall part of the plug body, wherein the shoulder member comprises an inner shoulder member and an outer shoulder member, wherein a diameter of an opening of the inner shoulder member is larger than a diameter of an opening of the outer shoulder member, wherein the cylindrical wall part of the plug body further comprises an upper containment wall part and a lower sidewall part, and an opening is disposed between the upper containment wall part and the lower sidewall part for discharging vaporized gas therefrom, wherein the male threaded part is protruded from a lower portion to a middle portion of an outer peripheral surface of the lower sidewall part, wherein a notch is disposed at an upper portion of the lower sidewall part, and the opening is formed by arranging the upper containment wall part on an upper side of the notch.

2. The plug body according to claim 1, further comprising:

a space forming part which forms a space on a lower side of the spout part, wherein an inlet of the pressure release valve is formed at the space forming part.

3. The plug body according to claim 1, further comprising:

a plug detachably provided at the spout part, wherein the plug is attached to a portion of the pressure release valve on an opposite side of the spout part side via a strap.

4. The plug body according to claim 1, wherein a passage extending in a direction having a vertical direction component is formed between an inlet and an outlet of the pressure release valve.

5. The plug body according to claim 1, further comprising:

a first sealing member separating an outlet of the pressure release valve and the opening.

6. The plug body according to claim 1, wherein the pressure release valve comprises an urging member which urges the valve body toward an inlet side.

7. A beverage container comprising:

the plug body according to claim 1; and the container in a bottomed cylindrical shape to which the plug body is attached.

8. The beverage container according to claim 7, wherein the pressure release valve is opposed to the spout part across an extending line of a cylinder axis of the container in a plan view.

9. The beverage container according to claim 7, wherein the plug body further comprises:

a first sealing member separating an outlet of the pressure release valve and the opening, and the beverage container further comprises a second sealing member which seals between a plug body attachment portion of the container and the shoulder member.

* * * * *